US006252489B1

(12) United States Patent
Chen

(10) Patent No.: US 6,252,489 B1
(45) Date of Patent: Jun. 26, 2001

(54) SWITCH STRUCTURE

(75) Inventor: Chun-Hsu Chen, Pan-Chiao (TW)

(73) Assignee: Tsung-Mou Yu, Panchiao (TW)

( * ) Notice: Subject to any disclaimer, the term of this patent is extended or adjusted under 35 U.S.C. 154(b) by 0 days.

(21) Appl. No.: 09/438,099

(22) Filed: Nov. 10, 1999

(51) Int. Cl.[7] ..... H01H 37/02; H01H 37/32; H01H 37/46

(52) U.S. Cl. ..... 337/37; 337/39; 337/59; 337/85; 337/112; 337/113; 337/66; 337/74

(58) Field of Search ..... 337/379, 79, 59, 337/66, 76, 53, 67, 68, 69, 74, 75, 91, 39, 85, 112, 113, 140, 334, 345; 200/553–557

(56) References Cited

U.S. PATENT DOCUMENTS

| | | | | |
|---|---|---|---|---|
| 3,358,099 | * | 12/1967 | Bellomayre | 200/113 |
| 4,258,349 | * | 3/1981 | Flory | 337/46 |
| 4,345,233 | * | 8/1982 | Matthies | 337/75 |
| 4,528,538 | * | 7/1985 | Anderson | 337/43 |
| 4,931,762 | * | 6/1990 | Fierro | 337/66 |
| 5,012,495 | * | 4/1991 | Munroe et al. | 37/0 |
| 5,262,748 | * | 11/1993 | Tsung-Mou | 337/66 |
| 5,451,729 | * | 9/1995 | Onderka et al. | 200/18 |
| 5,541,569 | * | 7/1996 | Jang | 337/68 |
| 5,760,672 | * | 6/1998 | Wang | 337/79 |
| 5,828,284 | * | 10/1998 | Huang | 337/37 |
| 5,847,638 | * | 12/1998 | Sorenson | 337/380 |
| 5,889,457 | * | 3/1999 | Hsu et al. | 337/59 |
| 5,892,426 | * | 4/1999 | Huang | 337/59 |
| 5,898,355 | * | 4/1999 | Yu | 337/8 |
| 6,072,381 | * | 6/2000 | Yu | 337/37 |
| 6,094,126 | * | 7/2000 | Sorenson | 337/37 |
| 6,121,868 | * | 9/2000 | Chiang | 337/37 |
| 6,154,116 | * | 11/2000 | Sorenson | 337/37 |

FOREIGN PATENT DOCUMENTS

| | | | | |
|---|---|---|---|---|
| 647094-A5 | * | 12/1984 | (CH) | 337/333 |
| 19534611-A1 | * | 3/1996 | (DE) | H01H/23/20 |
| 0694947-A1 | * | 1/1996 | (EP) | H01H/71/54 |

* cited by examiner

*Primary Examiner*—Leo P. Picard
*Assistant Examiner*—Anatoly Vortman

(57) ABSTRACT

A switch structure which includes an alloy piece, a contact control device, and a push device is disclosed. The contact control device includes an elastic part and connects to an end part so that the end part may reciprocally move with respect to the contact control device in a horizontal direction. The end part normally contacts with the upper side of the stopper placed in the switch body and is used to push the push device towards the end part when the alloy piece is overheated and strain is generated due to the current flowing through the alloy piece. The end part then elastically contracts and escapes from the stopper to fall down so that another end of the contact control device projects upwards and does not press the elastic contact plate. Therefore, the elastic contact plate may escape from the two contact points to cut off the power source rapidly by the elastic force to achieve the purpose of safety.

8 Claims, 7 Drawing Sheets

SWITCH STRUCTURE

FIELD OF THE INVENTION

The present invention relates to a switch structure, and more specifically, to a power switch with a simpler structure which is capable of switching off the power source when the current is overloaded.

BACKGROUND OF THE INVENTION

Power switches with only two states of ON/OFF function controlled manually have been widely used in many appliances. However, it is risky to use the above power switches when the power source is unstable because overheating may occur due to overloading of the appliance and the wire easily catches fire. The user can not be aware of such latent danger since overloading and overheating are invisible. Therefore, improved power switches have been greatly needed to overcome the danger.

Some improved power switches in the prior arts includes an alloy element composed of more than one metal to automatically shut off the power source when the alloy element is thermally deformed because of overheating.

For example, a conventional power switch comprises an alloy piece, a lever, and a cam actuator. The lever is actuated by the alloy piece, and the cam actuator is used to coordinate with a seesaw actuator. Thermal deformation of the alloy piece causes the lever to move, and then the cam actuator loses support, escapes and further shuts off the power source. Overheating may occur on he alloy piece. The above power switch uses the lever, the cam actuator, and the seesaw actuator to indirectly control the conductive plate, which is used to contact with the power source. The response of the power off operation in the above power switch when overheating occurs is so slow that the overloaded current may flow into the operating appliance in a short time to damage the appliance. Additionally, the conductive plate and the alloy piece need the wire to connect to each other, and the whole structure is complicated to cause the manufacturing difficult. The alloy piece has to actuate the seesaw actuator and the lever to escape. The function of automatic power off may incorrectly operate.

Furthermore, another conventional power switch uses the thermal deformation of the alloy piece to push a limited position base such that a button can automatically escape and return back. The button is used to directly contact with the contact point of the power source so that the button may conduct the overloaded current when overheating occurs. The whole structure is still complicated. In summary, those improved power switches in the prior arts can partly overcome the danger of overheating for the appliance but the response is slow and the whole structure is complicated. An advanced power switch with simpler structure and a short response time is greatly desired.

SUMMARY OF THF INVENTION

An object of the present invention is to provide a power switch, which consists of an alloy piece, a contact control device, and a push device. The contact control device includes an elastic part and connects to an end part so that the end part may reciprocally move with respect to the contact control device in a horizontal direction. The end part normally contacts with the upper side of the stopper placed in the switch body and is used to push the push device towards the end part when the alloy piece is overheated and strain is generated due to the current flowing through the alloy piece. The end part then elastically contracts and escapes from the stopper to fall down so that another end of the contact control device projects upwards and does not press the elastic contact plate. Therefore, the elastic contact plate may escape from the two contact points to shut off the power source rapidly by the elastic force to achieve the purpose of safety.

Other features and advantages of the invention will become apparent from the following description of the invention which refers to the accompanying drawings.

BRIEF DESCRIPTION OF THE DRAWINGS

FIG. 3 is a sectional view of the present invention illustrating the situation of the present invention when the switch is ON;

DETAILED DESCRIPTION OF THE PREFERRED EMBODIMENTS

Figure 1:
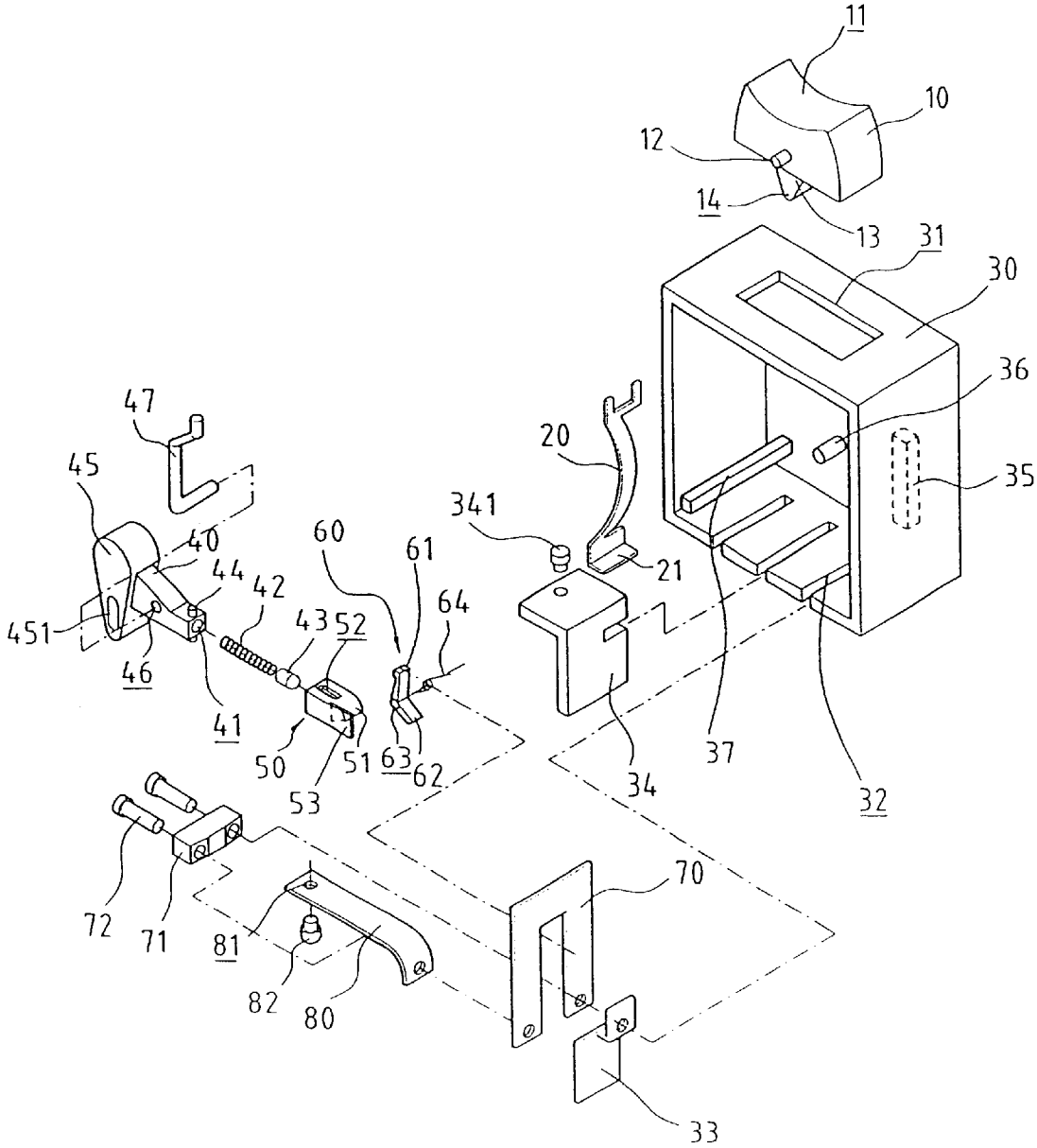
FIG. 1 shows a tree-dimensional exploded diagram according to the present invention.

With reference to FIG. 1, the power switch of the present invention comprises a switch cover body 10, an elastic device 20, a switch body 30, a push device 60, an alloy piece 70, and an elastic contact plate 80.

The switch cover body 10 consists of a concave cambered surface 11 on the surface, two fulcrums 12 on two opposite sides, respectively, and a triangular piece 13 on the bottom. The triangular piece 13 has a supporting rod hole 14.

The elastic device 20 has a hook body 21 at one end, which hooks the positioning rod 37 of the switch body 30 and the slit 371 on the inner side.

The switch body 30 is a hollow shell with an opening. The opening 31 on the top side connects to the switch cover body 10. The bottom side of the switch body 30 has a plurality of inserting grooves 32, which connect to the first contact terminal 33 and the second terminal 34, respectively. The second terminal 34 has a lower contact point 341 on the top side. The switch body 30 further has a stopper 35, a fixing pillar 36, a positioning rod 37, an axle rod 38, and a support rod 39 on the inner wall.

The contact control device 40 includes a convex hole 41. An elastic part(spring) 42 is placed in the convex hole 41. A pair of protruding rods 44 are located on two opposite upper and lower sides of the contact control device 40. On end of the contact control device 40 forms an oblique actuating part 45, which has a vertically elliptic fixing hole 451 used to connect the contact control device 40 to the fixing pillar 36 of the switch body 30. Additionally, a hole 46 is located at a suitable place on the contact control device 40. A supporting rod 47 of the contact control device 40 is used to connect to the supporting rod hole 14 of the switch cover body 10.

The contact control device 40 further includes an end part 50, which has a top support end 51 as a hook at one end. The bottom side of the end part 50 contacts with the upper side of the stopper 35 of the switch body 30. A push plate 53 is included in the outer side of the top support end 51. A slot hole 52 vertically penetrates through the end part 50 and combines with the protruding rod 44 so as to joint with the contact control device 40.

Moreover, the outer end of the elastic part(spring) 42 in the contact control device 40 may joint with a top push part 43 to form a shape of arc so as to more smoothly connect the end part 50 to the contact control device 40.

The push device (push bar)60 is composed of a push device head 61 and a push device end 62 to form an obtuse angle. An axial hole 63 to joint the push device head 61 and the push device end 62 is used to fix to the axle rod 38 of the switch body 30. A torsion spring 64 which rotates around the axle rod 38 and connects to the push device head 61 and the support rod 39 is used to further provide recovery force for the push device(push bar) 60.

The alloy piece 70 with an opening to the bottom side is hooked by the push device head 61.

The elastic contact plate 80 has a contact hole 81 at one end. A upper contact point 82 is combined with the bottom side of the elastic contact plate 80.

The above elastic contact plate 80 is joint to one leg of the alloy piece 70 by a fixing base 71 and a rivet 72. Another leg of the alloy piece 70 is fixed to the first contact end 33 so that the elastic contact plate 80 is on the first contact end 33 and the second contact end 34.

The ON/OFF operation of the present invention includes OFF, ON, and power off during overloading. The following is used to describe in more details.

Figure 2:
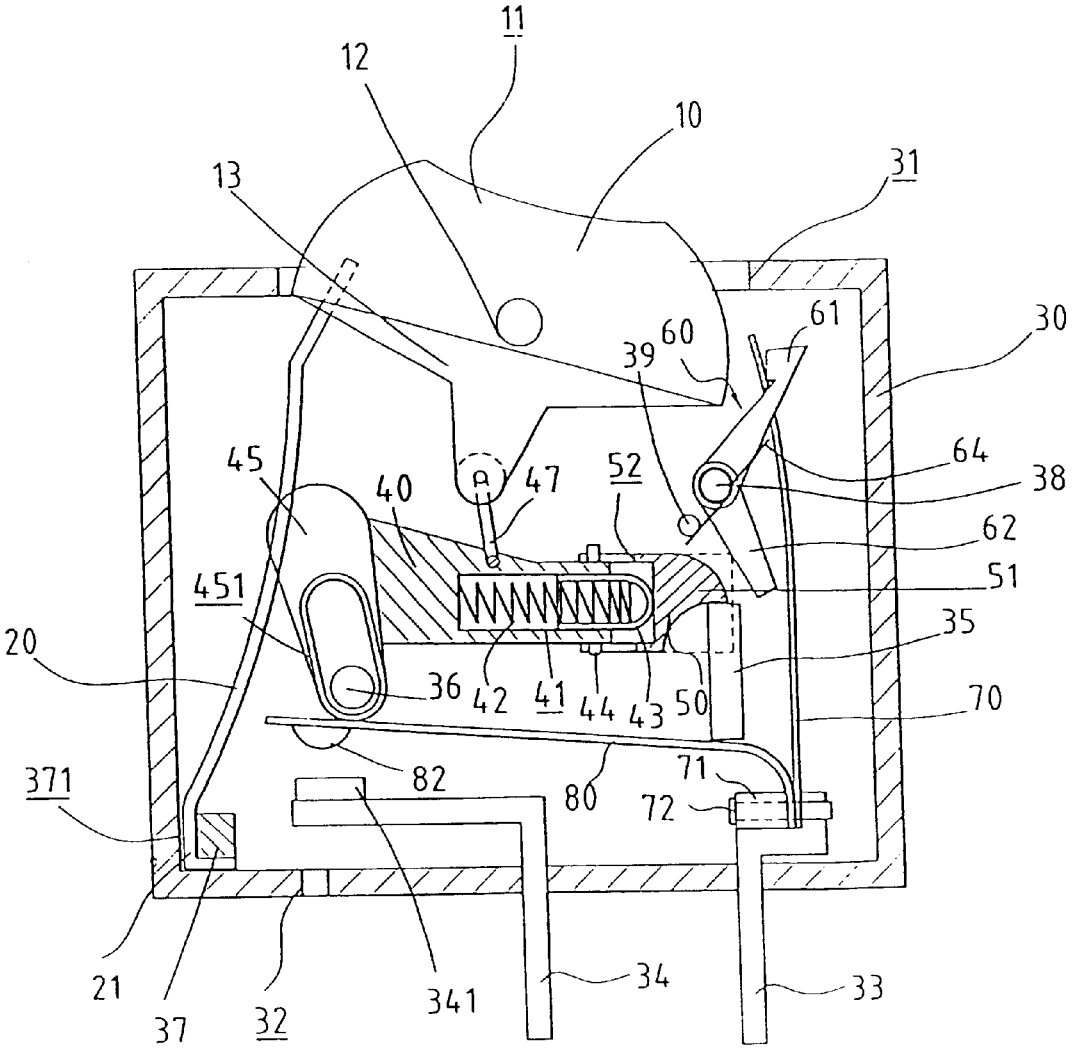
FIG. 2 is a sectional view of the present invention illustrating the situation of the present invention when the switch is OFF.

FIG. 2 illustrates the OFF operation according to the present invention. The OFF operation means the operator is required to open the switch to cut off the power source. When the operator pushes down the right end of the switch cover body 10, the elastic device 20 spreads upwards. The supporting rod 47 accordingly pulls up the actuating part 45 of the contact control device 40. The elastic contact plate 80 spring upwards because the actuating part 45 does not press the elastic contact plate 80, so as to separate the upper contact point 82 and the lower contact point 341. The first contact end 33 and the second contact end 34 is then open-circuited to cut off the power source.

Figure 3:
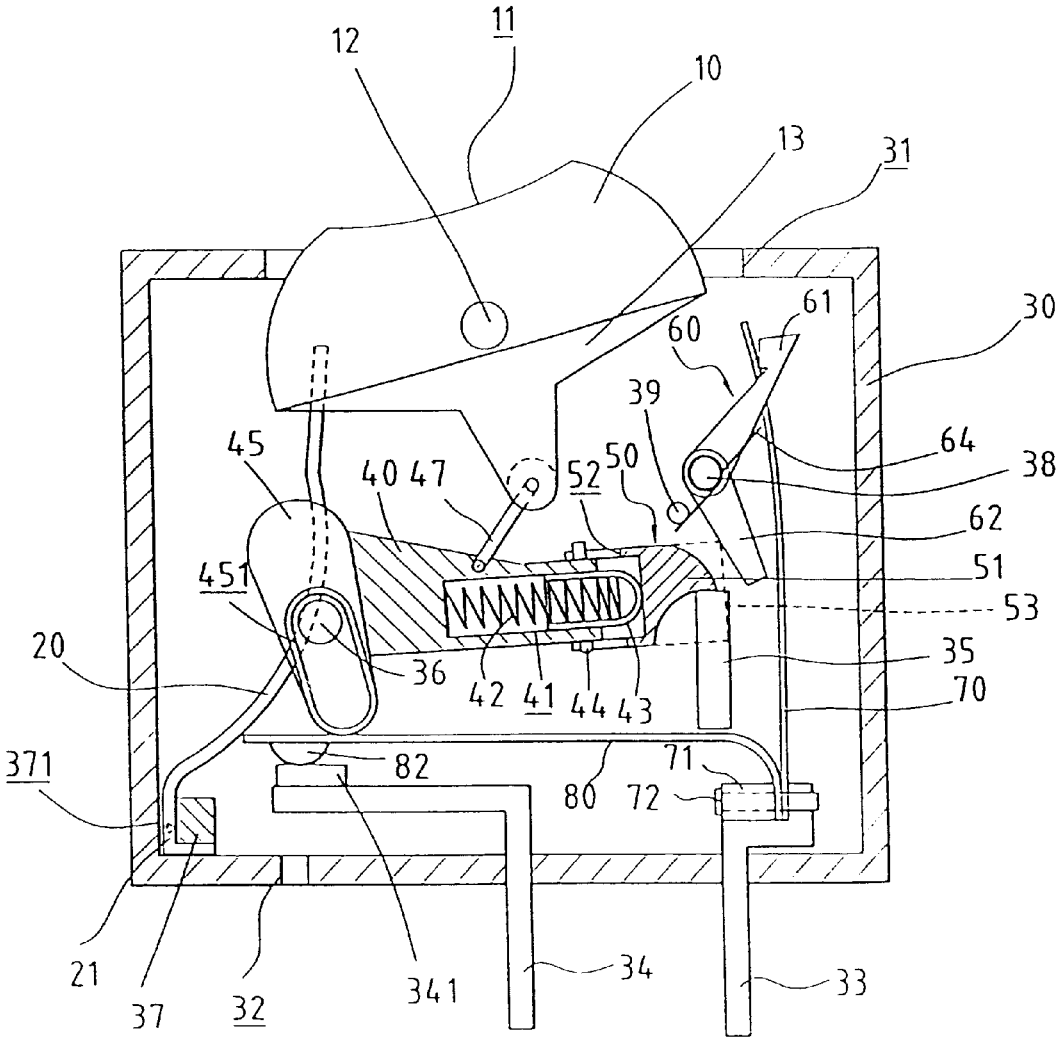

FIG. 3 illustrates the ON operation according to the present invention. The elastic device 20 is deformed when the operator pushes down the left end of the switch cover body 10. The switch cover body 10 counterclockwise rotates around the fulcrum 12 to make the supporting rod hole 14 also counterclockwise arc moves around the fulcrum 12(towards left direction in the present invention). The upper end of the supporting rod 47 presses the contact control device 40 and then the actuating part 45 downwards pushes the elastic contact plate 80 to connect the upper contact point 82 on the bottom side of the elastic contact plate 80 to the lower contact point 341 of the second contact end 34. The external power source flows through the first contact end 33, the alloy piece 70, the elastic contact plate 80. the upper contact point 82, and the lower contact point 341 to the second contact end 34 as an electric loop.

It should be noted that the top support end 51 of the end part 50 does not move and contacts with the stopper 35.

Figure 4:
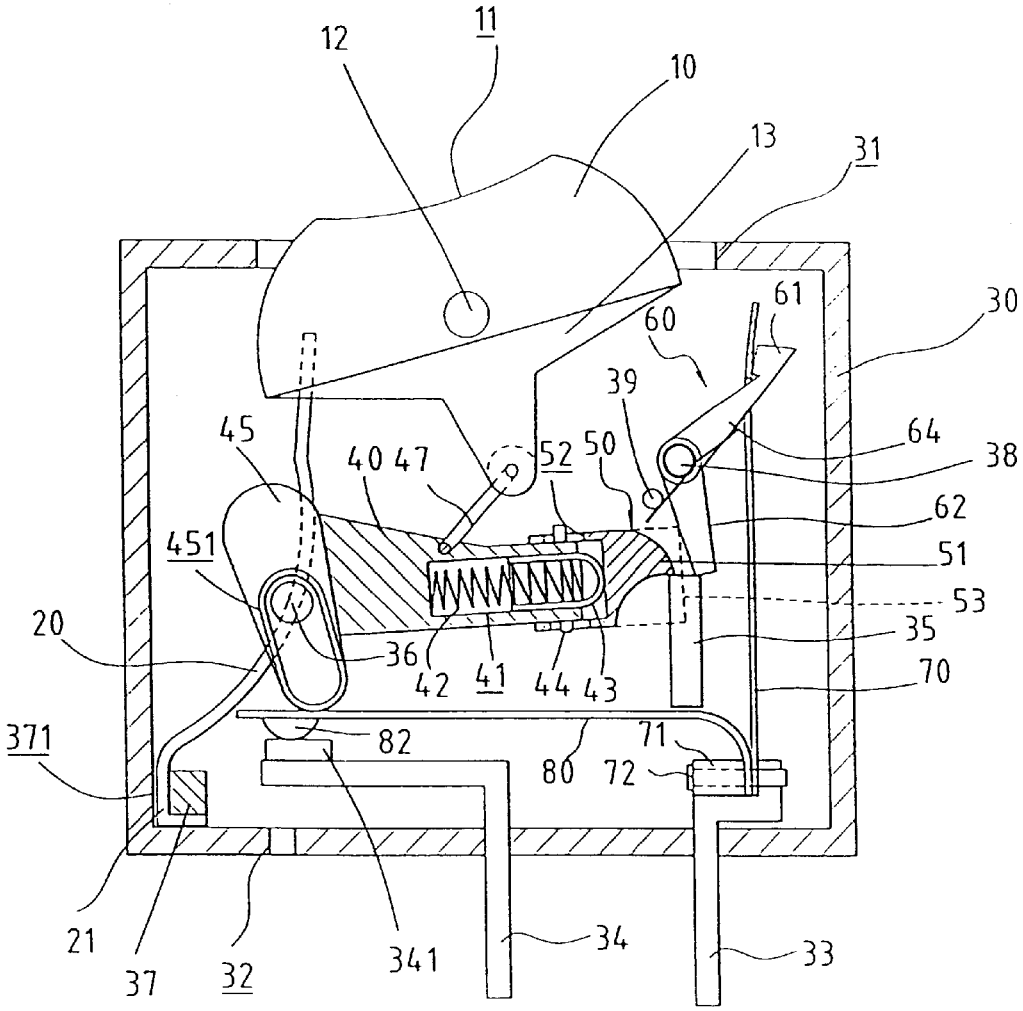
FIG. 4 is a sectional view of the present invention illustrating the operation of the present invention when the current is overloaded.
Figure 5:
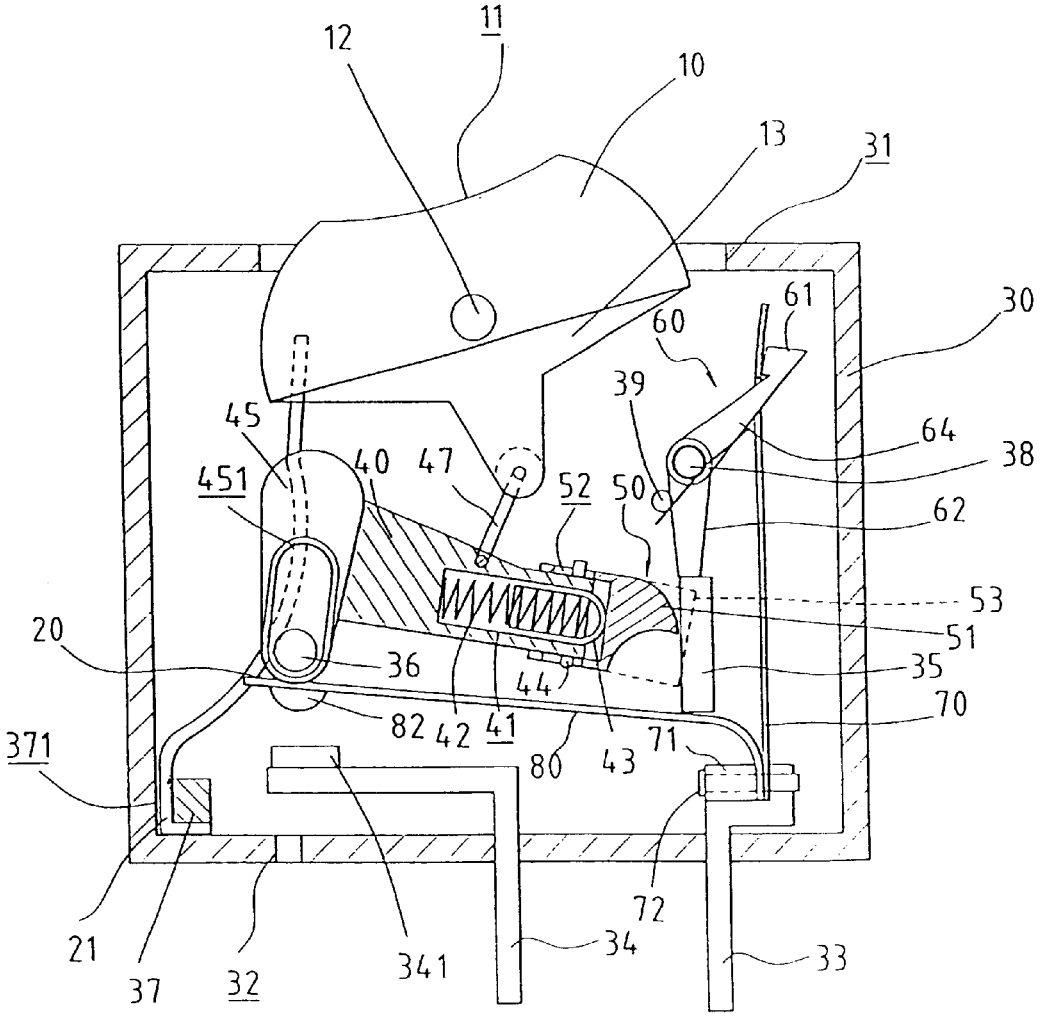
FIG. 5 is a sectional view of the present invention illustrating the operation of the present invention when the current is overloaded.

With reference to FIGS. 4 and 5, the alloy piece 70 bends towards one side (outwards in this embodiment)due to thermal deformation to pull the push device head 61 of the push device(push bar) 60 when the current is overloaded. The push device(push bar) 60 rotates around the axle rod 38 and the push device end 62 reverse pushes the push plate 53 of the end part 50. The end part 50 contracts towards the contact control device 40 so that the top support end 51 escapes from the top of the stopper 35. The end part 50 and the right end of the contact control device 40 fall down without the support of the stopper 35. The actuating part 45 at the left end of the contact control device 40 rotates around the convex hole 46 to move upwards so that the elastic contact plate 80 can move upwards with the actuating part 45. Therefore, the upper contact point 82 escapes from the lower contact point 341 to cut off the power source.

Additionally, after the end part 50 falls down, the elastic part(spring) 42 in the contact control device 40 spreads out and the top push part 43 pushes the end part 50 so that the end part 50 returns back to the original state of spreading out.

If the switch cover body 10 is not applied by any external force, the elastic device 20 will spread upwards to push up the switch cover body 10. The switch cover body 10 counterclockwise rotates around the fulcrum 12 to OFF position (as shown in FIG. 2) so that the contact control device 40 is pulled up by the supporting rod 47 and the alloy piece 70 cools down to return to the original state. The bottom side of top support end 51 included in the end part 50 presses the top side of the stopper 35 once again. This is OFF state (as shown in FIG. 2) to prepare for the next ON state.

Figure 6:
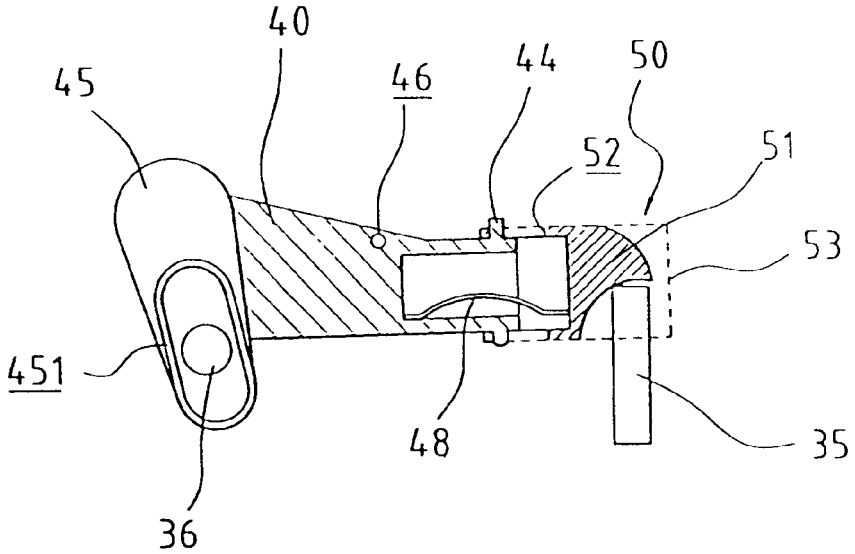
FIG. 6 shows a second embodiment of the present invention with a second control device.

With reference to FIG. 6, an arc elastic plate 48 may replace the elastic part(spring) 42 in the contact control device 40 as the second embodiment of the present invention.

Figure 7:
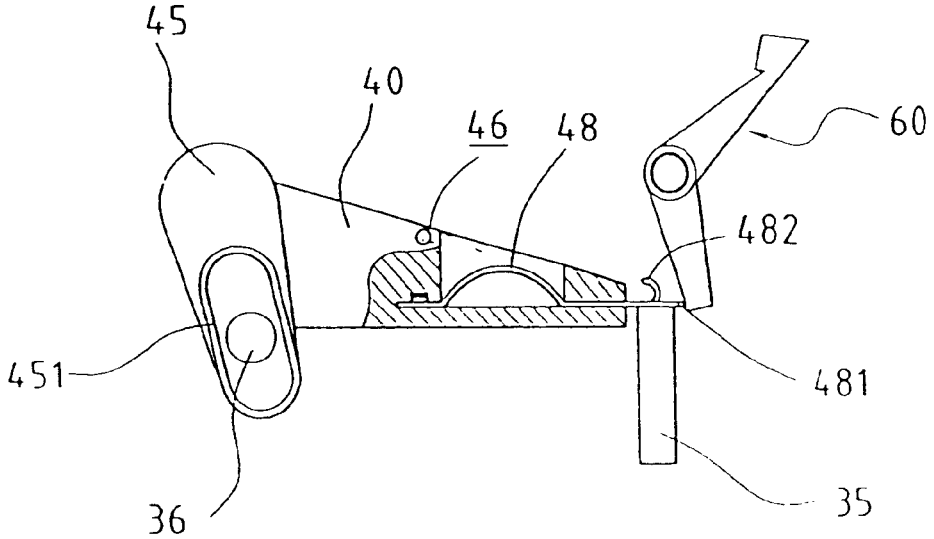
FIG. 7 shows a third embodiment of the present invention with a third control device.

FIG. 7 is the third embodiment of the present invention, which is modified from FIG. 6. The front end of the arc elastic plate 48 extends outwards to form a push plate 481, which has a top support end (hook)482 on the top side to push the top side of the stopper 35. The top support end (hook)482 is used to provide an arc to cause the contact control device 40 to return back to the original OFF state so that the bottom side of the top support end (hook)482 can smoothly push he top side of the stopper 35. The push plate 481 causes the push device 60 to push some desired part, as shown in FIGS. 4 and 5.

Figure 8:
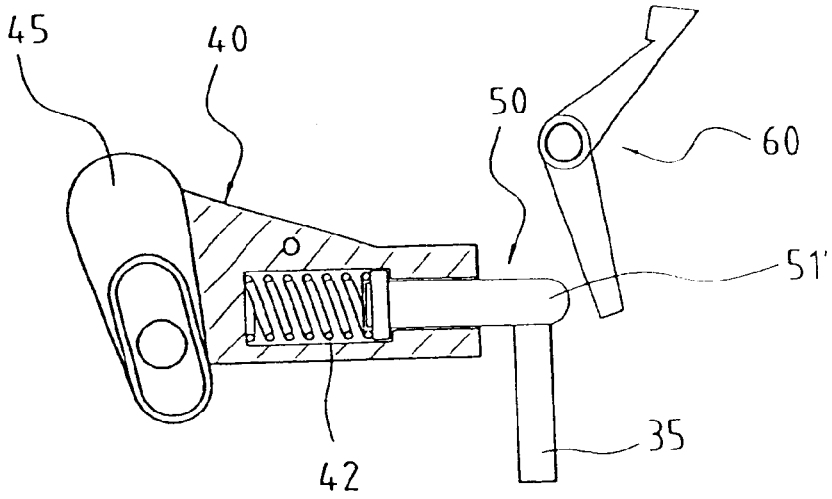
FIG. 8 shows a fourth embodiment of the present invention with a fourth control device.
Figure 9:
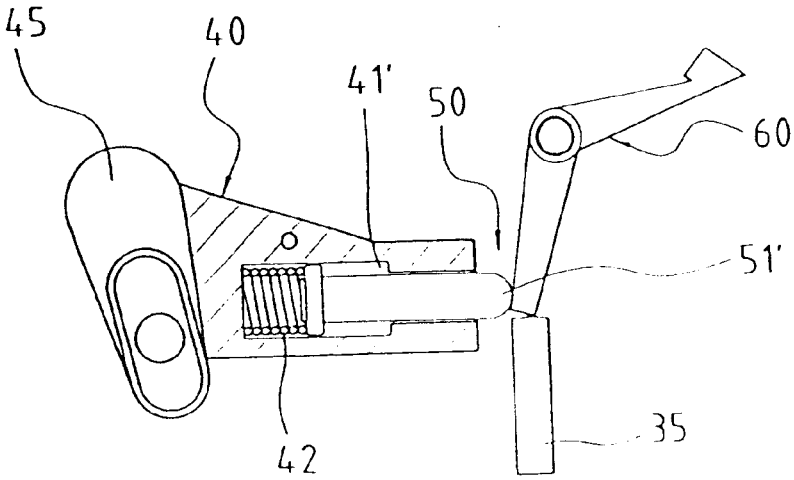
FIG. 9 shows a fifth embodiment of the present invention with a fifth control device.

FIGS. 8 and 9 show the fourth embodiment of the present invention. Another end of the contact control device 40 includes a convex hole 41', which is bigger at the inner end and smaller at the outer end. The elastic part(spring) 42 in the convex hole 41' pushes the end part 50 of the top support end 51'. The end part 50 presses down the top side of the stopper 35. The front end of the top support end 51' forms an arc surface to cause the push device 60 to push some desired part. The end part 50 may smoothly slides down from the top side of the stopper 35 or return to the top side of the stopper 35. The whole operation is the same as that of FIGS. 2, 3, 4, and 5. From the above description, the serial operation of the contact control device 40, the push device 60, and the alloy piece 70 causes the elastic contact plate 80 to rapidly escape to cut off the power source and return to a specific state preparing for the next ON state. Accordingly, the whole operation is quick and the structure of the power switch is simple without any risk of false operation.

Although only the preferred embodiments of this invention were shown and described in the above description, it is requested that any modification or combination that comes within the spirit of this invention be protected.

What is claimed is:

1. A switch structure, comprising a switch body, a switch cover body, an elastic device, an elastic contact plate, an alloy piece, a contact control device, and a push device; wherein said switch body has a stopper, a fixing pillar, and a axle rod; wherein said alloy piece is hooked by a head of said push device;

said contact control device connects to said switch cover body via a supporting rod and said contact control device comprises an actuating part at one end and an end part at another end, wherein said contact control device comprises an elastic part to provide elastic force to control the contact control device and said end part;

said push device comprises a push device head and a push device end, an axial hole in a central region of said push device, and a torsion spring provides recovery force to rotate;

said alloy piece becomes overheated and strained to push said push device when a current flowing through the alloy piece is overloaded, and said push device further pushes the end part of said contact control device to actuate said contact control device so as to shut off a power source by escaping said elastic contact plate.

2. The switch structure as claimed in claim 1, wherein said elastic part may connect with a top push part, which has a concave cambered surface.

3. The switch structure as claimed in claim 1, wherein said contact control device has two protruding rods at upper and lower sides of another end, respectively, to connect with said end part.

4. The switch structure as claimed in claim 3, wherein said end part has a slot hole through two sides to install said protruding rods of the contact control device.

5. The switch structure as claimed in claim 1, wherein said elastic part is a spring.

6. The switch structure as claimed in claim 1, wherein said elastic part is an arc elastic plate.

7. A switch structure, comprising: a switch body, a switch cover body, an elastic device, an elastic contact plate, an alloy piece, a contact control device, and a push device; wherein said switch body has a stopper, a fixing pillar, and a axle rod; wherein, said alloy piece is hooked by a head of said push device;

said contact control device connects to said switch cover body via a supporting rod and said contact control device comprises an actuating part at one end, which has a convex cambered surface at a lower end and an arc elastic plate at another end, wherein a front end of said arc elastic plate extends outwards to form a push plate to push said push device, wherein said push plate has a top support part at a side to contact with a upper side of said stopper;

said push device comprises a push device head and a push device end, an axial hole in a central region of said push device, and a torsion spring provides recovery force to rotate;

said alloy piece becomes overheated and strained to push said push device when a current flowing through the alloy piece is overloaded, and said push device further pushes the end part of said contact control device to actuate said contact control device so as to shut off a power source by escaping said elastic contact plate.

8. A switch structure, comprising: a switch body, a switch cover body, an elastic device, an elastic contact plate, an alloy piece, a contact control device, and a push device; wherein said switch body has a stopper, a fixing pillar, and a axle rod; wherein, said alloy piece is hooked by a head of said push device;

said contact control device connects to said switch cover body via a supporting rod and said contact control device comprises an actuating part at one end, which has a convex cambered surface; wherein said contact control device has a convex hole at another end, which is bigger at an inner end and smaller at an outer end;

wherein an elastic device is placed in said convex hole and contacts with an outward end of said top support part; wherein a bottom of said outward end of said top support part contacts with a upper side of said stopper; wherein said top support part is used to push said push device;

said push device comprises a push device head and a push device end, an axial hole in a central region of said push device, and a torsion spring provides recovery force to rotate;

said alloy piece becomes overheated and strained to push said push device when a current flowing through the alloy piece is overloaded, and said push device further pushes the end part of said contact control device to actuate said contact control device so as to shut off a power source by escaping said elastic contact plate.

* * * * *